United States Patent [19]

Drabert et al.

[11] 4,362,335

[45] Dec. 7, 1982

[54] ADJUSTABLE CHAIR BACKREST MECHANISM USING PNEUMATIC AND MECHANICAL SPRINGS

[76] Inventors: Fritz Drabert, Marienstrasse 37; Ulrich H. von Waldegge, Weidestr. 35, both of D-4950 Minden, Fed. Rep. of Germany

[21] Appl. No.: 193,872

[22] Filed: Oct. 3, 1980

[30] Foreign Application Priority Data

Oct. 5, 1979 [DE] Fed. Rep. of Germany ... 7928353[U]

[51] Int. Cl.[3] ..... A47C 3/00

[52] U.S. Cl. ..... 297/300; 248/575; 248/576; 297/285; 297/299

[58] Field of Search ..... 297/300, 304, 299, 285; 248/575, 576, 577, 578, 619

[56] References Cited

U.S. PATENT DOCUMENTS

| | | | |
|---|---|---|---|
| 3,572,828 | 3/1971 | Lerner | 248/575 X |
| 3,761,045 | 9/1973 | Sturhan | 248/576 X |
| 3,806,075 | 4/1974 | Sturhan | 248/575 |
| 3,912,248 | 10/1975 | Pickford et al. | 248/575 |
| 4,065,176 | 12/1977 | Fontana | 297/304 |

FOREIGN PATENT DOCUMENTS 2733322 2/1979 Fed. Rep. of Germany ..... 297/300

*Primary Examiner*—James T. McCall

*Attorney, Agent, or Firm*—Pollock, Vande Sande & Priddy

[57] ABSTRACT

A chair provided with a seat carrier and an associated backrest carrier includes a pneumatic spring connected between the seat carrier and backrest carrier, and a mechanical draw spring one end of which is connected directly to the backrest carrier and the other end of which is connected to an adjustable lever pivotally mounted on the seat carrier. The pneumatic spring and mechanical spring are disposed in side-by-side parallel relation to one another between a pair of generally vertical spaced bars forming a portion of the backrest carrier. The force exerted by the mechanical spring is in opposition to the restoring force exerted by the backrest carrier so that movement of the lever to increase the force exerted by the mechanical spring reduces the total restoring force exerted on the backrest carrier.

4 Claims, 3 Drawing Figures

ADJUSTABLE CHAIR BACKREST MECHANISM USING PNEUMATIC AND MECHANICAL SPRINGS

The invention relates to a chair having a seat with a seat carrier and a backrest with a backrest carrier, also having a pneumatic spring means and a mechanical spring providing a restoring force for the backrest.

Various embodiments of chairs are known, the adjustment of which takes place with the aid of pneumatic spring means. The use of pneumatic spring means has the advantage that an infinitely variable positioning of the elements of the chair adjusted thereby is assured. Furthermore, the pneumatic spring means can be made relatively small to save space when mounted on the chair. The exclusive use of pneumatic spring means however is disadvantageous because these means are not able to compensate for the various forces occurring as a result of the different weights of persons using the chair. A chair fitted with a normal pneumatic spring means may possibly meet the requirements resulting from the weight of the average person of say 70 kg. It is not possible, however, to make a chair with a pneumatic spring means which meets simultaneously the requirements of a heavy person of say 85 kg and the requirements of a light person of say 50 kg.

In order to adapt a chair to the various weights of different persons, it is already known to provide a mechanical spring with adjustable pre-stress parallel to the pneumatic spring means.

The purpose of the invention is to provide a construction of chair of the known type having a pneumatic spring means and a mechanical spring, in which the adjusting mechanism has a particularly reduced space requirement.

This purpose is achieved according to the invention in that one end of the pneumatic spring means and one end of the mechanical spring are linked to the backrest carrier, and the other end of the pneumatic spring means is connected to the seat carrier, whereas the other end of the mechanical draw spring is linked to an intermediary member connected to the seat carrier.

In a preferred embodiment of the invention the intermediary member is a lever pivotally connected to the seat carrier.

It has proved advantageous that the lever is adjustable by means of a spindle with a screw thread.

Finally it is suggested according to the invention that the spindle abuts a bearing provided on the seat carrier.

The arrangement of pneumatic spring means and mechanical spring according to the invention permits an especially space-saving mounting of these two tensioning devices. This arrangement also offers particularly favourable leverage conditions which facilitate exact adjustment and carefull adaption to the various load requirements.

Figure 1:
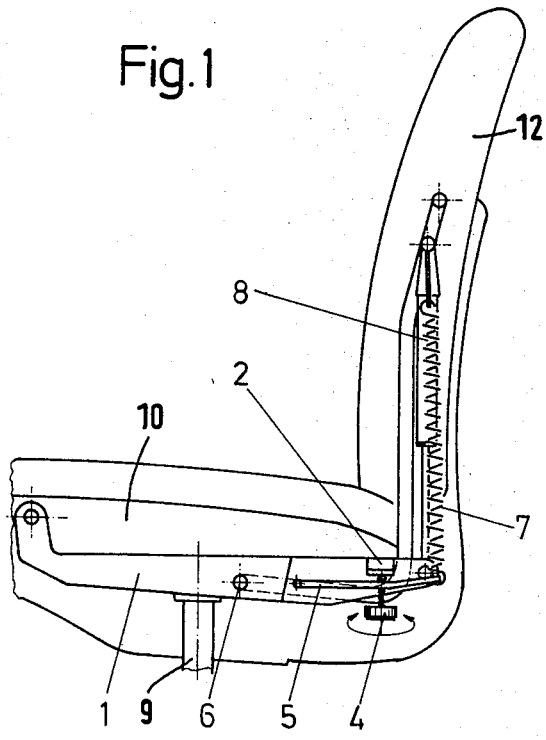
Figure 2:
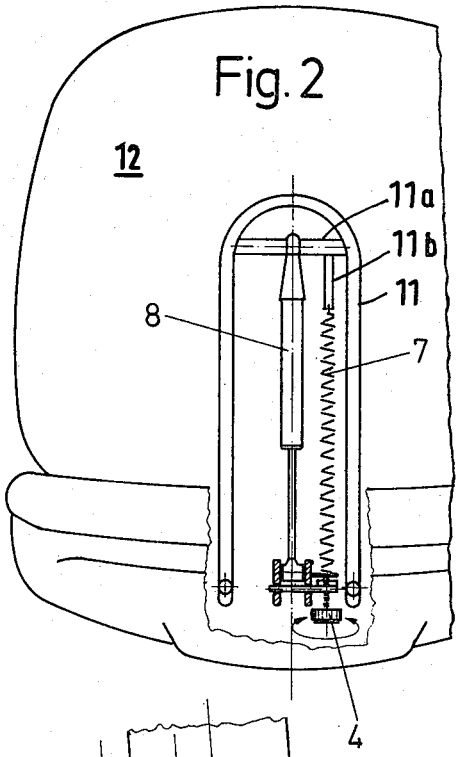
Figure 3:
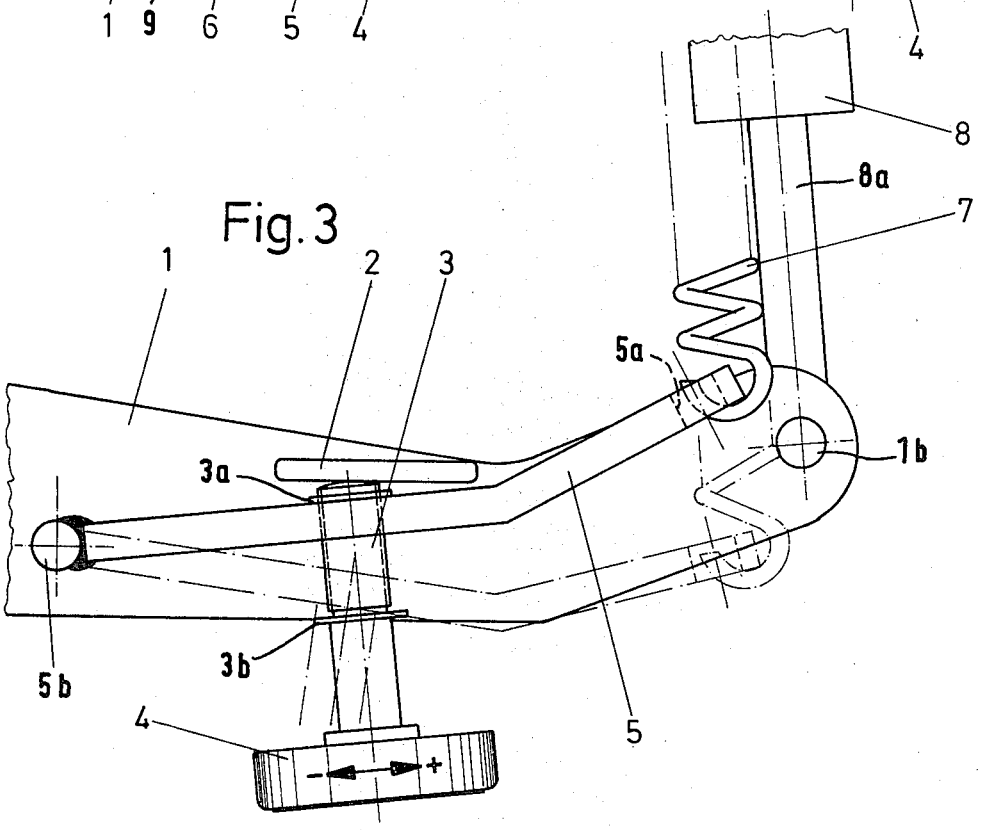

In the following, a preferred embodiment of the inovation will be described in detail with the aid of the drawings. Showing in:

FIG. 1 a schematic side view of a chair with the adjusting mechanism according to the invention, FIG. 2 a schematic rear view of the chair shown in FIG. 1, FIG. 3 an enlarged illustration of the arrangement of the adjusting elements.

A seat carrier 1 is mounted on the upper end and rotatable about the central axis of a vertical column 9 which is secured at the lower end to a base support not shown. The seat 10 is secured to the seat carrier in a manner not illustrated. A backrest carrier 11 consisting of two angled bars is linked at 6 to the seat carrier 1. The backrest 12 is secured to the backrest carrier 11 in a manner not illustrated. The backrest carrier 11 has a horizontal strut 11*a* to which the upper end of the pneumatic spring means 8 is linked. Also on the strut 11*a* is a post 11*b* extending downwards parallel to the pneumatic spring means 8. The piston rod 8*a* of the pneumatic spring means 8 is linked at 1*b* to the seat carrier 1. A draw spring 7 is secured at its upper end to the lower end of the post 11*b* and extends therefrom parallel to the upwardly inclined bars of the backrest carrier 11. The lower end of the draw spring 7 is hooked in a hole 5*a* provided in the pivotally mounted lever 5. The lever 5 is mounted at pivot 5*b* by its forward end on the seat carrier 1. Screwed through the lever 5 is a threaded spindle, the adjustmemt of which is limited by an upper flange 3*a* and a lower flange 3*b*. The threaded spindle 3 can be rotated by means of the hand wheel 4, and abuts a bearing 2 which is rigidly secured to the seat carrier 1. In FIG. 3, the lever 5 is shown in a position in which the mechanical draw spring 7 has the least pre-tension. Broken lines indicate the position of the the lever 5 in FIG. 3 in which the draw spring 7 is most extended.

The force of the adjustable draw spring 7 is in opposition to the restoring force of the pneumatic spring means 8. When the tension of the draw spring 7 is increased the total restoring force acting on the backrest carrier is reduced.

In the position shown in complete lines in FIG. 3, the pre-tension of the draw spring 7 is negligible, so that when the lever 5 assumes this position the normal restoring force of the pneumatic spring means is effective.

We claim:

1. In a chair of the type comprising a base support, a vertical column attached at its lower end to said base support, a seat carrier rotatably mounted on the upper end of said column for supporting a generally horizontal seat, a backrest carrier disposed adjacent said seat carrier for supporting a generally vertical backrest, and spring means attached to said backrest carrier for resiliently positioning said backrest relative to said seat and for providing a restoring force to said backrest carrier when it is angularly displaced relative to said seat, the improvement wherein said backrest carrier comprises a pair of laterally spaced bars each of which includes a generally horizontal portion the forward end of which is pivotally attached to said seat carrier at a first point located between the front and rear edges of said seat carrier, the rearward end of the said generally horizontal portion of each bar being integral with a generally vertical portion of said bar that extends in an upward direction adjacent to the rear edge of said seat carrier, a structural member extending between and interconnecting the vertical portions of said bars at a position above and relatively widely spaced from the rear edge of said seat carrier, said spring means comprising a generally vertically oriented pneumatic spring located between and extending generally parallel to the vertical portions of said bars, said pneumatic spring being operative to exert a restoring force on said backrest carrier and comprising a cylinder and piston one of which is directly attached to said structural member and the other of which is directly attached to the rear edge of said seat carrier, a generally horizontal lever located between and extending generally parallel to the horizontal portions of said laterally spaced bars, said lever having a forward end which is pivotally attached to said seat carrier at a second point that is located between one of said first points and the rear edge of said seat carrier, the rear end of said lever being disposed closely adjacent to the rear edge of said seat carrier, said spring means further comprising a generally vertically oriented mechanical draw spring located between the generally vertical portions of said bars and extending parallel to said pneumatic spring, the upper end of said mechanical draw spring being attached to said structural member and the lower end of said mechanical draw spring being attached to the rear end of said lever, an abutment located on said seat carrier above and overlying said lever, a generally vertical spindle located below said seat carrier adjacent the rear edge thereof and extending through said lever in thread engagement with said lever, the upper end of said spindle bearing on said abutment, and a hand wheel attached to said spindle for rotating said spindle to move said lever toward and away from said abutment by angularly displacing the rear end of said lever about said second point thereby to vary the force which is exerted on said backrest carrier by said mechanical draw spring, the force exerted by said mechanical draw spring being in opposition to the restoring force exerted on said backrest carrier by said pneumatic spring whereby angular movement of said lever in a direction which increases the force that is exerted by said mechanical draw spring operates to reduce the total restoring force exerted on said backrest carrier by said spring means.

2. The chair of claim 1 wherein the generally vertical portions of said bars are located forward of the rear edge of said seat carrier.

3. The chair of claim 2 wherein said pneumatic spring is substantially equidistantly spaced from the generally vertical portions of said bars, said mechanical draw spring being located between said pneumatic spring and the generally vertical portion of one of said bars.

4. The chair of claim 3 wherein said structural member comprises a strut extending horizontally between the generally vertical portions of said bars, the cylinder of said pneumatic spring being connected to said strut, and a vertical post attached to said strut and extending downwardly from said strut between said cylinder and the generally vertical portion of one of said bars, the upper end of said mechanical draw spring being connected to the lower end of said post.

* * * * *